US007794137B2

(12) United States Patent
Golay et al.

(10) Patent No.: US 7,794,137 B2
(45) Date of Patent: Sep. 14, 2010

(54) TOURBILLON FOR TIMEPIECE

(75) Inventors: Jean-Pierre Golay, Sion (CH); Pierre-Michel Golay, Prangins (CH)

(73) Assignee: Franck Müller Watchland S.A. (CH)

( * ) Notice: Subject to any disclaimer, the term of this patent is extended or adjusted under 35 U.S.C. 154(b) by 0 days.

(21) Appl. No.: 11/860,878

(22) Filed: Sep. 25, 2007

(65) Prior Publication Data

US 2008/0074955 A1 Mar. 27, 2008

(30) Foreign Application Priority Data

Sep. 25, 2006 (CH) ..... 1522/06

(51) Int. Cl.
*G04B 15/00* (2006.01)
*G04B 19/20* (2006.01)

(52) U.S. Cl. ..... 368/127; 368/142

(58) Field of Classification Search ..... 368/127, 368/142

See application file for complete search history.

(56) References Cited

U.S. PATENT DOCUMENTS 4,117,664 A * 10/1978 Mathys ..... 368/318
5,838,641 A * 11/1998 Tohkoku et al. ..... 368/127
6,749,333 B2 * 6/2004 Scheufele ..... 368/127
7,270,474 B2 * 9/2007 Agnoff ..... 368/206
7,316,504 B1 * 1/2008 Mock et al. ..... 368/127
2003/0151981 A1 * 8/2003 Vernay et al. ..... 368/37
2004/0184356 A1 * 9/2004 Dias ..... 368/127
2006/0187760 A1 * 8/2006 Kasapi ..... 368/127
2007/0041276 A1 * 2/2007 Jansen et al. ..... 368/127
2007/0097797 A1 * 5/2007 Agnoff ..... 368/206

* cited by examiner

*Primary Examiner*—Vit W Miska
*Assistant Examiner*—Sean Kayes
(74) *Attorney, Agent, or Firm*—Ostrolenk Faber LLP

(57) ABSTRACT

A tourbillon is disclosed which presents a carriage comprising an upper bridge 1, a lower bridge 2 and an escapement bridge 3 supporting a balance spring 4, an escapement wheel 5 and a pallet assembly 6, the lower bridge 2 presenting a circular periphery designed to fit into a groove on the outer edge of three pivoting rollers positioned between a plate and bridges of a corresponding timepiece.

19 Claims, 5 Drawing Sheets

TOURBILLON FOR TIMEPIECE

TECHNICAL FIELD

The invention relates to a tourbillon for a clock movement, a clock movement and a timepiece equipped with such a tourbillon.

STATE OF THE ART

Various systems are known for reducing the running rate variation of a wristwatch while it is being worn. The tourbillon is one of the most commonly used systems as the rotating of the regulating device (generally 1 revolution per minute) enables the rate differences in vertical positions to be practically eliminated.

The carriage or cage of the tourbillon is generally either held in place by two pivots, one in the plate and the other in a bridge, or pivoted in a ball bearing, which makes it more visible on the dial side.

DISCLOSURE OF THE INVENTION

A purpose of the invention is to eliminate the guidance of the carriage of the tourbillon at the centre and improve the guidance of the carriage and the general aesthetics of the movement of the watch.

This invention thus provides for the guidance of the carriage to be carried out on the periphery of the tourbillon, thus improving the visibility of the carriage.

The tourbillon according to a preferred embodiment of the invention, for clock movement of the type comprising a frame on which the tourbillon is designed to be fitted, may comprise a carriage, carrying a balance spring, and an escapement, and comprise a bridge designed to present a movement of rotation with respect to the frame of the clock movement. The tourbillon may be characterised by the fact that the bridge presents a circular periphery capable of cooperating with at least three rollers mounted so as to pivot on the clock movement to ensure the suspension and positioning of the tourbillon on the frame.

The invention is also directed to a clock movement comprising at least three rollers pivoting with respect to the frame of the movement and between which a tourbillon presenting the above characteristics is suspended and guided.

According to a preferred mode of execution, one of the pivoting rollers may be mobile in a transverse direction with respect to its axis of rotation, in such a way as to enable the engagement and mounting of the carriage between the rollers.

The clock movement may advantageously present an eccentric enabling the position of the mobile roller on the frame to be adjusted precisely, in order to carry out adjustment of the clearances of the assembly.

The mobile roller may be mounted on an arm pivoting between an opening position and a carriage locking position.

The carriage may present an upper bridge, a lower bridge and an escapement bridge supporting a balance spring, an escapement wheel and a pallet assembly.

Preferably, the lower bridge may present a circular configuration and its periphery may be designed to fit into a groove on the outer edge of each of the rollers.

The tourbillon may be driven by a pinion attached under the carriage. Alternatively, the tourbillon may be driven by a toothed ring attached to a bridge of the carriage, preferably a lower bridge, that is to say located on the bridge side of a movement in which the tourbillon is mounted.

With the tourbillon according to the invention, the guidance of the carriage at the centre may be replaced by the guidance of the three rollers positioning the lower bridge of the carriage axially and radially from the outside. The guidance of the carriage is thus better and more precise than the guidance provided by the central pivots. In addition, the visibility of the tourbillon in a timepiece integrating it is thus considerably improved both from the dial side and from the timepiece back side.

BRIEF DESCRIPTION OF THE DRAWINGS

The drawing represents, as an example, two modes of execution of a suspended tourbillon according to the invention.

DETAILED DESCRIPTION OF THE INVENTION

Figure 1:
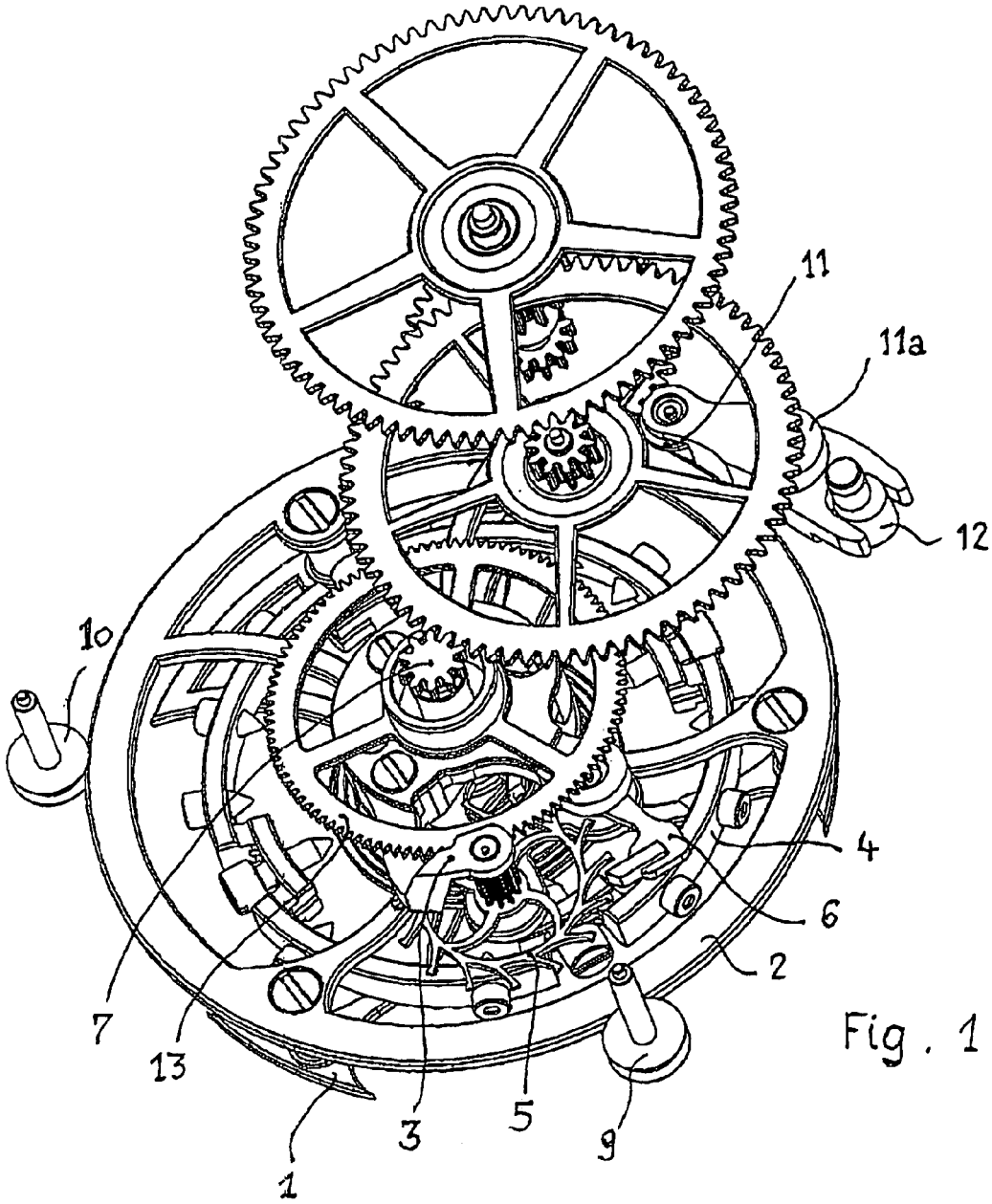
FIG. 1 is a perspective view of a suspended tourbillon with driving of the carriage of the tourbillon by a central pinion attached to said carriage.
Figure 2:
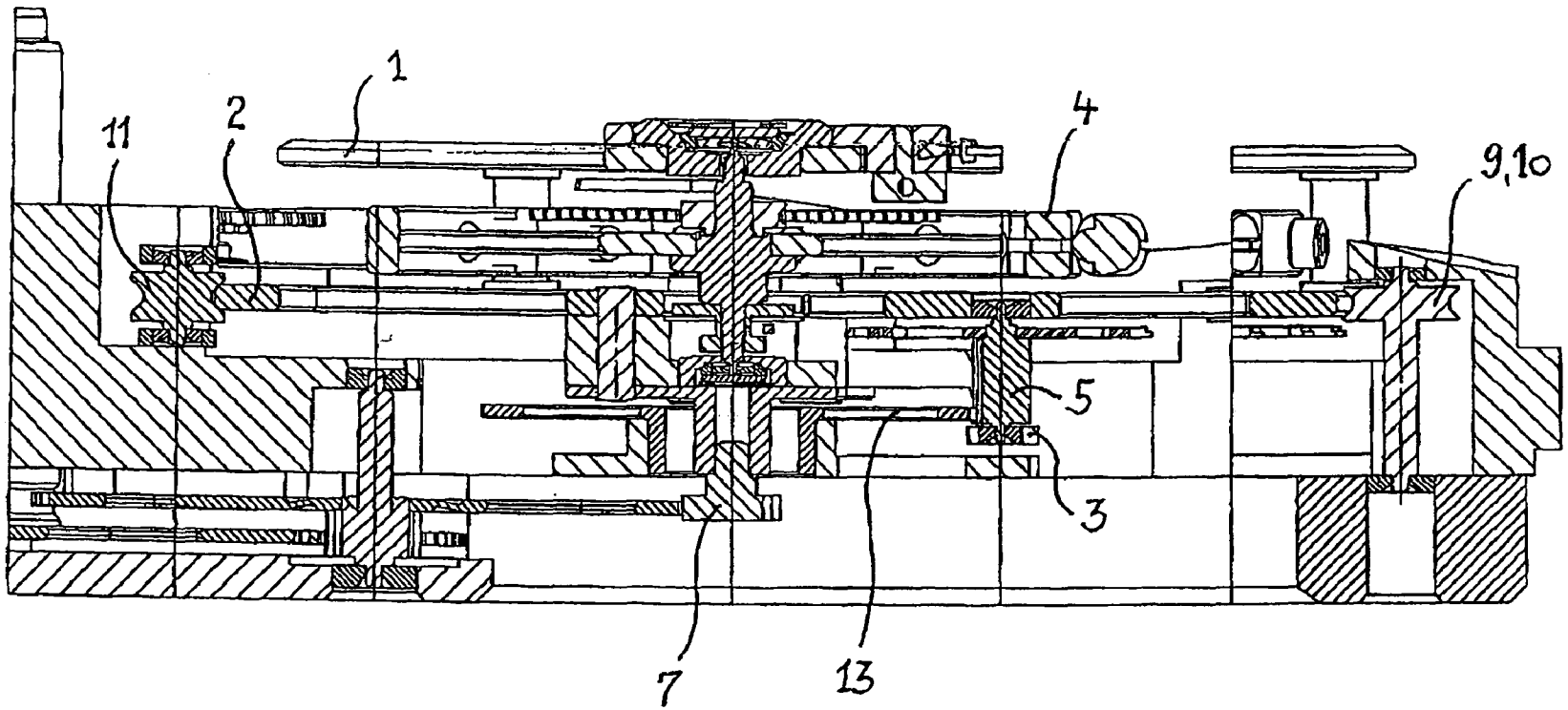
FIG. 2 is a section of the tourbillon shown in FIG. 1 in a sectional plane containing the axes of rotation of the carriage and the escapement wheel.
Figure 3:
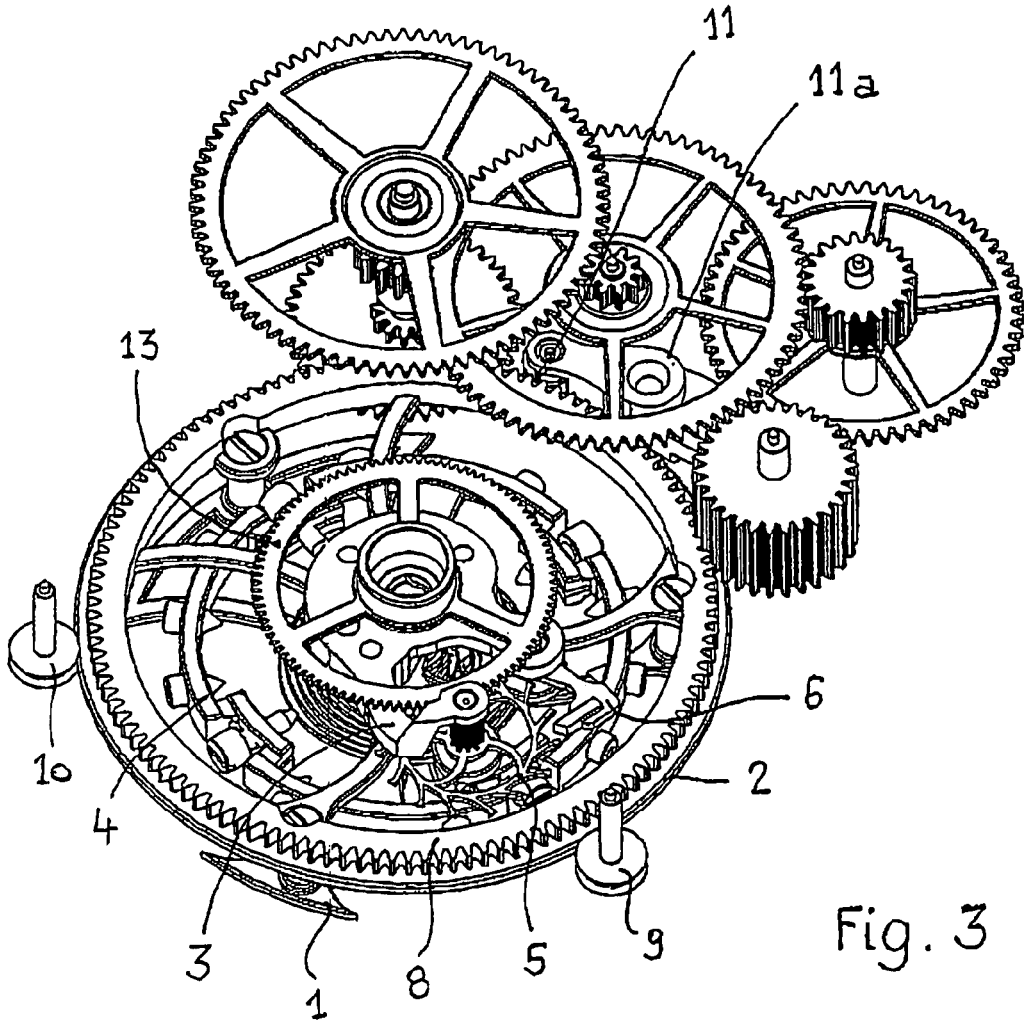
FIG. 3 is a perspective view of a second mode of execution of a suspended tourbillon with driving of the tourbillon carriage by an outer toothed ring attached to the lower bridge of the carriage.
Figure 4:
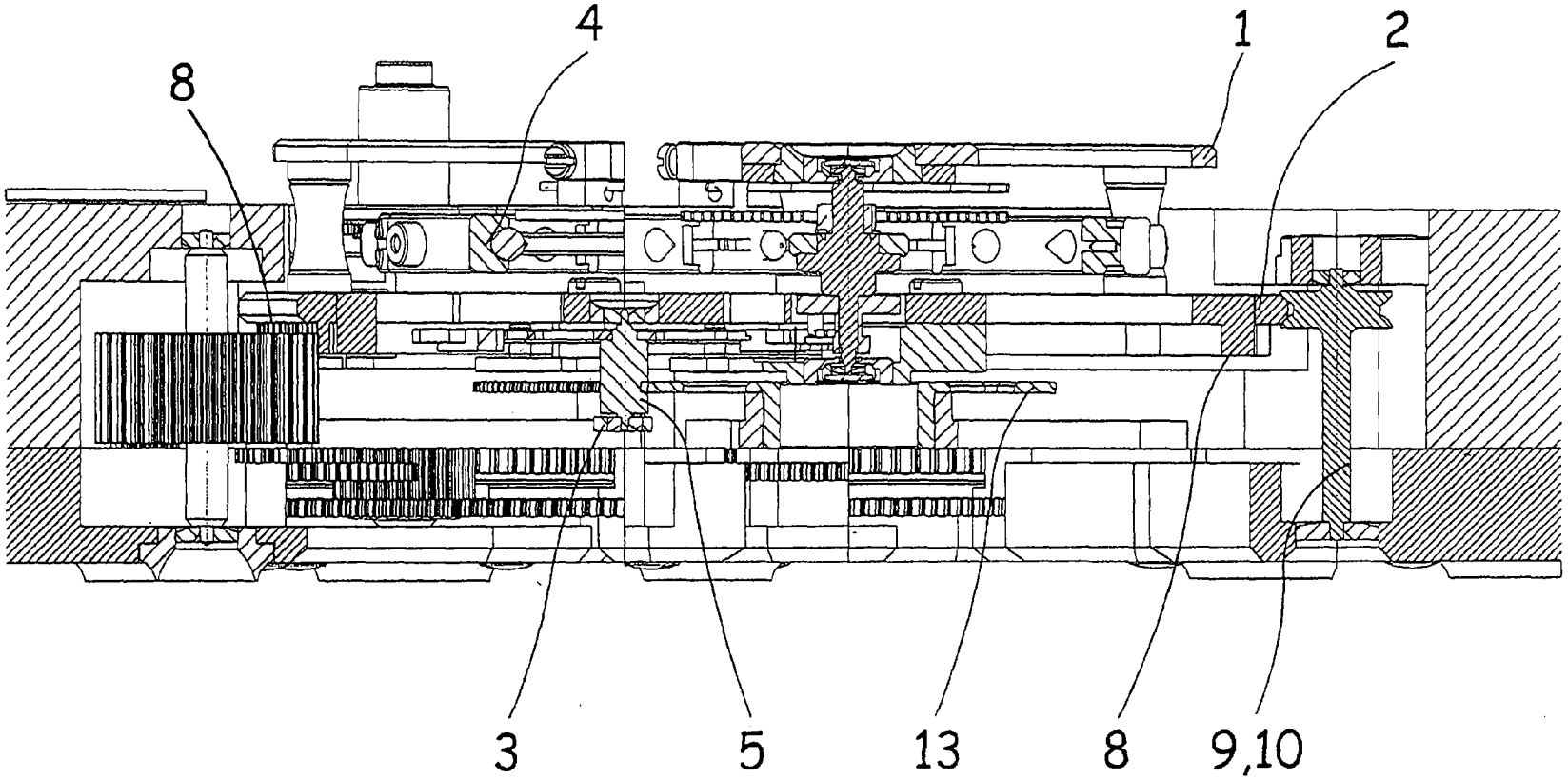
FIG. 4 is a section of the tourbillon shown in FIG. 3 in a sectional plane containing the axes of rotation of the carriage and the escapement wheel.

For a better understanding of the two modes of execution of the mechanism illustrated in FIGS. 1 to 4, the frame elements of the clock movement, notably the plate and the bridges, have not been shown in the perspective views in FIGS. 1 and 3. The tourbillon illustrated in the drawing was developed for a wristwatch. This use is not limitative, however, and the tourbillon illustrated in the drawing may be mounted in pocket watches or small clocks.

The suspended tourbillon illustrated in the two variants of the drawing may comprise a tourbillon carriage or cage comprising an upper bridge 1, a lower bridge 2 and an escapement bridge 3 carrying a balance spring 4, an escapement wheel 5 and a pallet assembly 6. The carriage is driven either by a pinion 7 attached under the carriage (FIG. 1) or by a toothed ring 8 attached to lower bridge 2 of the carriage (FIG. 3). Lower bridge 2 of the carriage may be designed to be able to be positioned axially and radially by means of two fixed rollers 9 and 10 and a mobile roller 11.

The latter is connected to the frame of the movement in such a way as to be mobile between two extreme positions in a transverse direction with respect to its axis of rotation. As shown as an example, the mobile roller may be carried by an arm 11*a* pivoting between an opening position enabling the engagement of the carriage between the rollers and a locking position which can be adjusted by means of an eccentric 12 placed on the pivoting arm. In a known manner, a modification of the orientation of the eccentric makes it possible to adjust the position of the mobile roller with respect to the frame of the movement. The regulating device of the tourbillon carriage is placed in motion in a conventional manner by means of a fixed wheel 13 attached to the plate, not shown, and arranged in engagement with escapement wheel 5.

Figure 5:
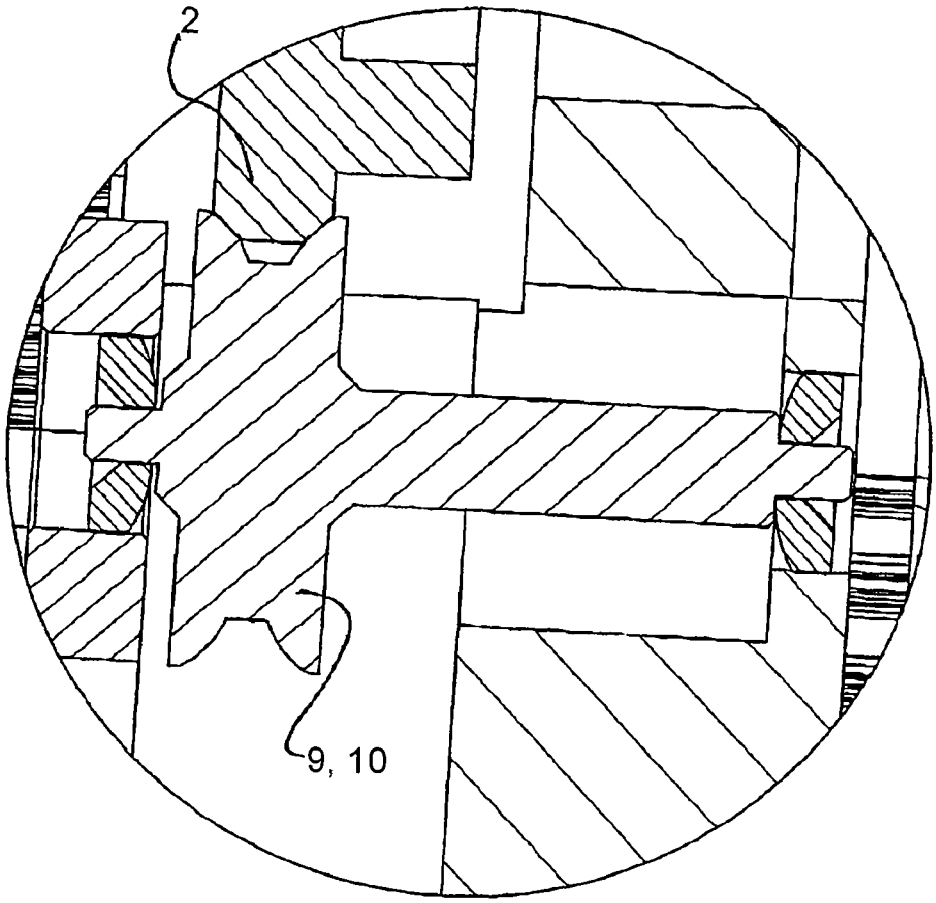
FIG. 5 is an enlarged view of portions of FIGS. 2 and 4.

As shown in the drawings, lower bridge 2 may present a circular periphery designed to fit in an annular groove on the outer edge of each of rollers 9, 10 and 11. FIG. 5 indicates, with greater clarity than FIGS. 2 and 4, the cone shape of the annular groove on the outer edge of each of rollers 9 and 10, roller 11 also having a cone-shaped annular groove on its outer edge, as shown in FIG. 2. Advantageously, the surfaces of the periphery of bridge 2, on the one hand, and of the grooves, on the other hand, may be of substantially complementary shapes.

The one skilled in the art will be able to assemble the rollers on the frame of the movement in the manner most appropriate to his needs without departing from the scope of this invention. In particular, fixed rollers 9 and 10 may be mounted on shafts pivoting in jewels of the frame, one in the plate and the other in a bridge, or on single bearings of the ball bearing type, for example.

The positioning and the guidance of the carriage, carried out on the outside of said carriage, thus make its functioning visible on the bottom of the movement as well as on the top.

What is claimed is:

1. A tourbillon for a clock movement, the clock movement comprising a frame on which said tourbillon is designed to be fitted, said tourbillon comprising a cage carrying a balance spring, and an escapement and comprising a bridge designed to present a movement of rotation with respect to said frame of said clock movement, said bridge presenting an outer circular periphery capable of cooperating with at least three rollers mounted so as to pivot on said clock movement to ensure suspension and positioning of said tourbillon on said frame, the tourbillon being driven by a toothed ring meshing along its entire circumference with teeth along an inner circular periphery of the bridge.

2. The tourbillon of claim 1, wherein said outer circular periphery presents a surface shaped in such a way as to be substantially complementary to a surface of each roller of said clock movement with which it is intended to be in contact.

3. The tourbillon of claim 1, comprising a lower bridge, an upper bridge and an escapement bridge supporting said balance spring, an escapement wheel and a pallet assembly, said lower bridge being designed to cooperate with said rollers of said clock movement.

4. A clock movement comprising the tourbillon of claim 1, wherein at least one of said rollers is arranged on said frame in such a way as to be mobile between two extreme positions in a transverse direction with respect to its axis of rotation.

5. The clock movement of claim 4, comprising an eccentric, a modification of the orientation of the eccentric making it possible to adjust the position of said mobile roller with respect to said frame.

6. The clock movement of claim 5, wherein said outer circular periphery of said bridge presents a surface shaped in such a way as to be substantially complementary to a surface of each of said rollers with which it is intended to be in contact.

7. The clock movement of claim 5, wherein each of said rollers presents an annular groove designed to cooperate with said outer circular periphery of said bridge.

8. A timepiece comprising a case containing a clock movement according to claim 5.

9. The clock movement of claim 4, wherein said mobile roller is mounted so as to rotate on an arm pivoting on said frame between an opening position and a locking position of said tourbillon cage.

10. The clock movement of claim 9, wherein said outer circular periphery of said bridge presents a surface shaped in such a way as to be substantially complementary to a surface of each of said rollers with which it is intended to be in contact.

11. The clock movement of claim 6, wherein each of said rollers presents an annular groove designed to cooperate with said outer circular periphery of said bridge.

12. The clock movement of claim 4, wherein said outer circular periphery of said bridge presents a surface shaped in such a way as to be substantially complementary to a surface of each of said rollers with which it is intended to be in contact.

13. A timepiece comprising a case containing a clock movement according to claim 12.

14. The clock movement of claim 4, wherein each of said rollers presents an annular groove designed to cooperate with said outer circular periphery of said bridge.

15. A timepiece comprising a case containing a clock movement according to claim 4.

16. A clock movement comprising the tourbillon of claim 1, wherein said outer circular periphery of said bridge presents a surface shaped in such a way as to be substantially complementary to a surface of each of said rollers with which it is intended to be in contact.

17. A timepiece comprising a case containing a clock movement according to claim 16.

18. A clock movement comprising the tourbillon of claim 1, wherein each of said rollers presents an annular groove designed to cooperate with said outer circular periphery of said bridge.

19. A timepiece comprising a case containing a clock movement comprising a tourbillon according to claim 1.

* * * * *